US006861806B2

(12) United States Patent
Kumada et al.

(10) Patent No.: US 6,861,806 B2
(45) Date of Patent: Mar. 1, 2005

(54) SUPER-HIGH PRESSURE DISCHARGE LAMP OF THE SHORT ARC TYPE

(75) Inventors: Toyohiko Kumada, Himeji (JP); Yoshitaka Kanzaki, Hyogo-ken (JP); Masanobu Komiya, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/273,292

(22) Filed: Oct. 18, 2002

(65) Prior Publication Data

US 2003/0076040 A1 Apr. 24, 2003

(30) Foreign Application Priority Data

Oct. 19, 2001 (JP) ..... 2001-321920

(51) Int. Cl.[7] ..... H01J 17/18

(52) U.S. Cl. ..... 313/623; 313/625; 313/631; 313/639; 313/571; 313/572; 313/567

(58) Field of Search ..... 313/631, 634, 313/636, 639, 623–625, 567

(56) References Cited

U.S. PATENT DOCUMENTS 4,959,587 A * 9/1990 Schug ..... 313/623
5,109,181 A 4/1992 Fischer et al.
5,200,669 A * 4/1993 Dixon et al. ..... 313/623
5,497,049 A 3/1996 Fischer
6,132,279 A 10/2000 Horiuchi et al.
6,181,064 B1 * 1/2001 Narita ..... 313/623
6,538,383 B1 * 3/2003 Takeuchi ..... 313/637
6,583,565 B2 * 6/2003 Nishida et al. ..... 313/634
6,590,341 B1 * 7/2003 Kitano et al. ..... 313/623
6,661,172 B2 * 12/2003 Kuti et al. ..... 313/624
2001/0033138 A1 * 10/2001 Uchikawa et al. ..... 313/623
2001/0038265 A1 * 11/2001 Nishida ..... 313/631

FOREIGN PATENT DOCUMENTS

JP 11176378 A * 7/1999 ..... H01J/61/20
JP 11-176385 A 7/1999

* cited by examiner

*Primary Examiner*—Ashok Patel
*Assistant Examiner*—Sikha Roy
(74) *Attorney, Agent, or Firm*—Nixon Peabody LLP; David S. Safran

(57) ABSTRACT

An arrangement with relatively high pressure tightness in a super-high pressure mercury lamp of the short arc type which is operated with an extremely high mercury vapor pressure is achieved by the super-high pressure mercury lamp having the following characteristic:

an arc tube portion in which there is a pair of opposed electrodes, and which is filled with greater than or equal to 0.15 mg/mm$^3$ of mercury; and side tube portions which extend from opposite sides of the arc tube portion, in which the electrodes are partially hermetically enclosed, and in which the electrodes and metal foils are welded to one another, and the width of the metal foils in the weld areas is so small that it is less than or equal to the diameter of these electrodes.

8 Claims, 3 Drawing Sheets

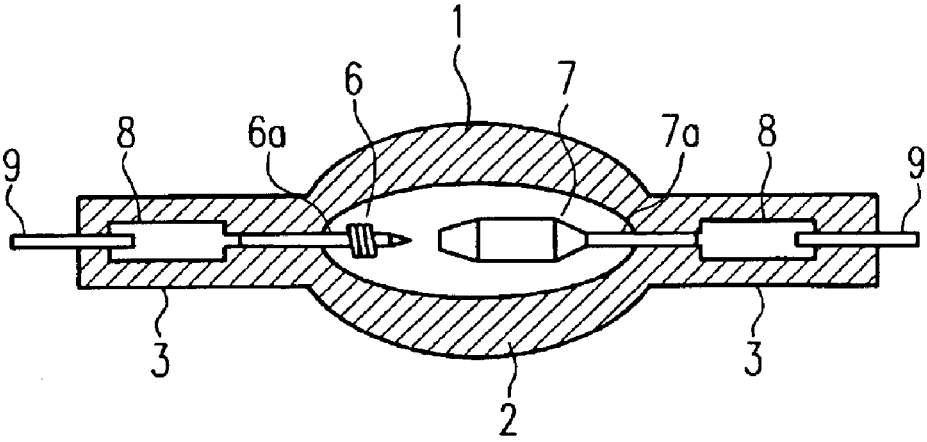
Fig. 1
Fig.2(a)
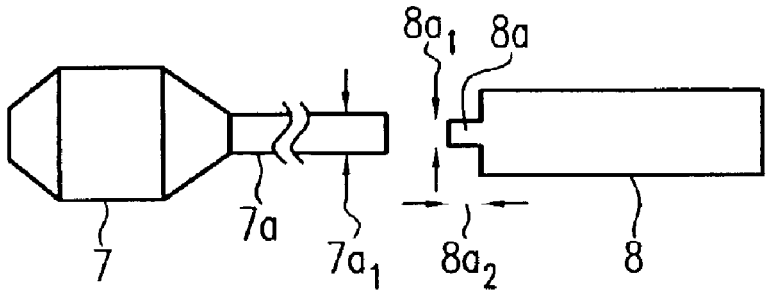
Fig.2(b)
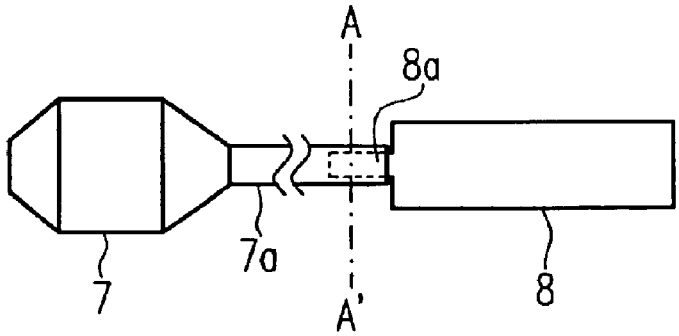
Fig.2(c)
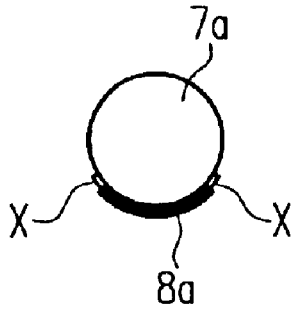

SUPER-HIGH PRESSURE DISCHARGE LAMP OF THE SHORT ARC TYPE

BACKGROUND OF THE INVENTION

1. Field of the Invention

The invention relates to a super-high pressure discharge lamp of the short arc type in which the mercury vapor pressure during operation is at least 150 atm. The invention relates especially to a super-high pressure discharge lamp of the short arc type which is used as the backlight of a liquid crystal display device, a projection device, such as a DLP (digital light processor), or the like, in which a DMD (digital mirror device) is used.

2. Description of Related Art

In a projector device of the projection type, there is a demand for uniform illumination of the images onto a rectangular screen with sufficient color reproduction. The light source is thus a metal halide lamp which is filled with mercury and a metal halide. Furthermore, recently smaller and smaller metal halide lamps, and more and more often spot light sources, have been produced, and lamps with extremely small distances between the electrodes have been used in practice.

Against this background, instead of metal halide lamps, lamps with an extremely high mercury vapor pressure, for example, with 150 atm, have recently been proposed. Here, the increased mercury vapor pressure suppresses broadening of the arc (the arc is compressed) and a major increase of the light intensity is desired.

Such a super-high pressure discharge lamp is disclosed, for example, in Japanese patent disclosure document HEI 2-148561 (U.S. Pat. No. 5,109,181) and in Japanese patent disclosure document HEI 6-52830 (U.S. Pat. No. 5,497,049).

In such a super-high pressure discharge lamp, the pressure in the arc tube during operation is extremely high. In the side tube portions which extend from opposite sides of the arc tube portion, it is therefore necessary to arrange the silica glass comprising these side tube portions, the electrodes and the metal foils for current supply in a sufficient amount and moreover, fixed directly tightly adjoining one another. The reason for this is that the added gas emerges or cracks form when this adhesive property is not adequate.

Therefore, in the process of hermetic sealing of the side tube portions, for example, at a high temperature of 2000° C., the silica glass is heated, and in this state, the viscous silica glass is gradually contracted or the silica glass is subjected to a pinch seal. This improves the adhesive property of the side tube portions.

However, if the silica glass bums at an overly high temperature, the disadvantage arises that, after completion of the discharge lamp, the side tube portions are easily damaged, even if the adhesion of the silica glass to the electrodes or metal foils improves. This disadvantage is explained in detail below.

In the stage after heat treatment in which the temperature of the side tube portions gradually drops, due to the difference of relative amounts of expansion, as a result of the difference between the coefficient of thermal expansion of the material (tungsten) comprising the electrodes and the coefficient of thermal expansion of the material (silica glass) comprising the side tube portions, cracks form in the contact areas of the two. The cracks are extremely small. However, the cracks grow during lamp operation and in the super-high pressure state during operation. It can be imagined that this would cause damage to the discharge lamp.

To eliminate this defect, the arrangement shown in FIG. 6 is proposed. In the figure, the side tube portions 3 are connected to the arc tube portion 2 of a discharge lamp 1. In the side tube portions 3, the electrodes 6, 7 within the arc tube portion 2 are each connected to a metal foil 8. Electrode rods 6*a*, 7*a* are installed in the side tube portions 3 and are each wound with a coil component 10. In this arrangement, the stress exerted on the silica glass a result of thermal expansion of the electrode (rods) is relieved by the coil components 10 which are wound around the electrode rods. This arrangement is described, for example, in Japanese patent disclosure document HEI 11-176385.

However, even if this arrangement reduces the thermal expansion of the electrodes, in reality, in the vicinities of the electrodes 6,7, the electrode rods 6*a*, 7*a* and the coil components 10, cracks remain. These cracks are admittedly very small; but, there are cases in which they often lead to damage to the side tube portions 3 in the case of a mercury vapor pressure of the arc tube portion 2 of roughly 150 atm. In recent years, there has been a demand for a very high mercury vapor pressure of 200 atm or 300 atm. At such a high mercury vapor pressure, crack growth is accelerated during lamp operation. This results in the disadvantage that the side tube portions 3 are conspicuously damaged. This means that cracks during lamp operation at a high mercury vapor pressure gradually become large, even if they are extremely small at the start. It can be stated that eliminating this disadvantage is a new technical object which is never present in a mercury lamp with a vapor pressure from roughly 50 atm to 100 atm during operation.

SUMMARY OF THE INVENTION

The invention was devised to eliminate the above described disadvantage of the prior art. The object of the invention is to devise an arrangement with relatively high pressure tightness in a super-high pressure mercury lamp which is operated with an extremely high mercury vapor pressure.

This object is achieved according to a first aspect of the invention in a super-high pressure mercury lamp of the short arc type which comprises the following:

an arc tube portion in which there is a pair of electrodes opposite, and in which the arc tube is filled with mercury in an amount of at least 0.15 mg/mm$^3$ of the inside volume of the arc tube and side tube portions which extend to both sides of the arc tube portion and in which the electrodes are partially hermetically enclosed, and in which the electrodes and metal foils are welded to one another, the width of the metal foils at the above described weld points with the electrodes is so small that it is less than or equal to the diameter of these electrodes.

The object is achieved according to a second aspect of the invention in a super-high pressure mercury lamp of the short arc type which comprises the following:

an arc tube portion in which there is a pair of electrodes opposite, and in which the arc tube is filled with mercury in an amount of at least 0.15 mg/mm$^3$ of the inside volume of the arc tube and side tube portions which extend to both sides of the arc tube portion, in which the electrodes are partially hermetically enclosed, and in which the electrodes and metal foils are welded to one another, the metal foils are wrapped around the electrode in an unwelded area near the respective weld area of the foil to the respective electrode.

In the super-high pressure discharge lamp of the short arc type of the invention, the above described arrangement reduces the size of the gap in the side tube portions, and thus, the attempt is made to suppress formation and growth of extremely small cracks.

Specifically, in the discharge lamp as is shown in FIG. 5, a gap X inevitably forms between the metal foil 8 and the upholding part 7*a* of the electrode. It was found that, by applying the super-high pressure of the arc tube portion to this gap X, crack formation is intensified. Specifically, it has been found that the presence of such a gap X, as such, leads to formation, growth and intensification of the cracks, even if the difference between the two coefficients of thermal expansion is advantageously reduced by the above described winding of the coil parts around the upholding part of the electrode.

In the invention, by the new application of the above described arrangement, in the side tube portions, the electrodes can be advantageously welded to the metal foils, and moreover, the gap X can be minimized by an extreme amount, i.e., to the degree at which it would hardly form in reality.

The invention is explained in detail below using several embodiments shown in the drawings.

BRIEF DESCRIPTION OF THE DRAWINGS

FIG. 1 is a cross-sectional view of a super-high pressure discharge lamp of the short arc type in accordance with the invention;

FIGS. 2(*a*)–2(*c*) each show a partial view of a foil and electrode of the super-high pressure discharge lamp of the short arc type according to the invention;

DETAILED DESCRIPTION OF THE INVENTION

Figure 3:
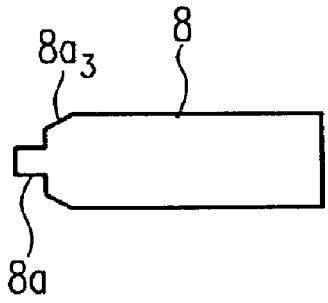
FIG. 3 shows a partial view of a foil of the super-high pressure discharge lamp of the short arc type in accordance with the invention.

FIG. 1 shows the overall arrangement of the super-high pressure discharge lamp in accordance with the invention (hereinafter, also called only a "discharge lamp"). In the figure, a discharge lamp 1 has an essentially spherical arc tube portion 2 which is formed from a silica glass discharge vessel and in which there are a cathode 6 and an anode 7 arranged facing toward each other. The side tube portions 3 are made such that they extend to the opposite ends of the arc tube portion 2. A conductive metal foil 8, which normally is made of molybdenum, is hermetically installed, for example, by a pinch seal in these side tube portions 3. The electrode rods 6*a*, 7*a* have a cathode 6 and an anode 7, respectively, on the tip thereof, and their other end is welded to the inner end of the metal foil 8 so as to be electrically connected to it. To the other end of the respective metal, foil 8, a respective outer lead 9 is welded and projects out of the respective side tube 3. The cathode 6 and the anode 7, including the electrode rods 6*a* and 7*a*, are also called "electrodes" hereinafter.

The arc tube portion 2 is filled with mercury, a rare gas, and a halogen gas. The mercury is used to obtain the necessary wavelengths of visible light, for example, to obtain radiant light with wavelengths from 360 nm to 780 nm, and is contained in an amount of greater than or equal to 0.15 mg/mm$^3$. This contained amount differs depending on the temperature condition. However, an extremely high vapor pressure is achieved at pressures of at least 150 atm during operation. By adding a larger amount of mercury, a discharge lamp with a high mercury vapor pressure of at least 200 atm or 300 atm can be produced. The higher the mercury vapor pressure, the more suitable the light source for a projector device which can be built.

As the rare gas, for example, roughly 13 kPa argon gas is added. The rare gas is used to improve the operating starting property. Iodine, bromine, chorine, or the like in the form a compound with mercury or other metals is added as the halogen. The amount of halogen added can be, for example, in the range of $10^{-6}$ $\mu$mole/mm$^3$ to $10^{-2}$ $\mu$mole/mm$^3$. The halogen added also functions to prolong the service life using the halogen cycle. It can be imagined that, for an extremely small discharge lamp with a high internal pressure, as in the discharge lamp of the invention, this addition of a halogen affects the phenomenon described above, such as damage and devitrification of the discharge vessel.

The numerical values of one such discharge lamp are described by way of example below. For example:

the maximum outside diameter of the arc tube portion is 9.5 mm;

the distance between the electrodes is 1.5 mm;

the internal volume of the arc tube is 75 mm$^3$;

the wall load is 1.5 W/mm$^2$;

the rated voltage is 80 V; and the rated wattage (power) is 150 W.

This discharge lamp is installed in the above described projector device and in a display device such as an overhead projector or the like and can emit radiant light with good color reproduction.

FIGS. 2(*a*) to 2(*c*) each schematically show the base point of the anode of the super-high pressure discharge lamp of the invention, enlarged. FIG. 2(*a*) shows the anode 7 and the metal foil 8 before connection. FIG. 2(*b*) shows the state after connecting the anode 7 to the metal foil 8. FIG. 2(*c*) is a cross section taken along the line A14–A' in FIG. 2(*b*). The metal foil 8 has a rectangular overall shape, but according to the connection site to the electrode has a tip area 8*a* with a small width. The width $\mathbf{8}a_1$ of this tip area 8*a* is smaller than the diameter $\mathbf{7}a_1$ of the upholding part 7*a* of the electrode to which the metal foil is to be connected. In this way, the gap X which inevitably arises at the connection point of the electrode axis 7*a* (hereinafter, also called the upholding part of the electrode) to the metal foil 8 can be eliminated or drastically reduced. As a result, cracks which form proceeding from this gap X can be advantageously prevented. FIGS. 2(*b*) and 2(*c*) show the connecting state of the electrode axis 7*a* to the metal foil 8. Here, essentially in the entire area of the tip area 8*a* with a small width, welding to the electrode axis 7*a*, for example, resistance welding, is carried out.

Numerical values are described below by way of example.

The diameter of the upholding part 7*a* of the electrode is selected from the range of 0.3 mm to 1.5 mm and is, for example, 0.8 mm. The width of the tip area 8*a* of the metal foil is selected from the range of 0.3 mm to 1.5 mm and is, for example, 0.8 mm. With respect to the feed action of the metal foil to the electrode, it is more advantageous for the width of the tip area 8*a* of the metal foil to be large and for it to be at least 70% of the diameter of the upholding part 7*a* of the electrode. The quantity $8a_2$ in the lengthwise direction of the tip area of the metal foil is selected from the range of 0.1 mm to 5 mm, and is, for example, 1.5 mm. It is advantageous for the upholding part of the electrode to be located in this area and connected to the metal foil. This is because, when the upholding part of the electrode is extended beyond the tip area 8*a* up to a great width, there is the danger than in this area the inevitable gap will form.

FIG. 3 shows another embodiment of the metal foil. As shown in FIG. 3, the area $8a_3$ which is adjacent to the tip area 8*a* of the metal foil 8 can also be made tapering instead of forming a rectangular edge.

Figure 4A:
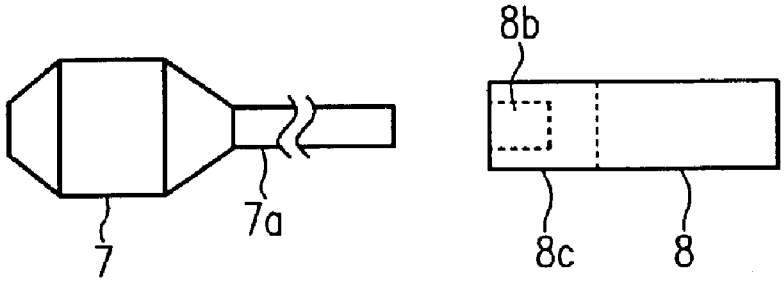
FIGS. 4(*a*) to 4(*c*) each show a partial view of a of a second embodiment of a foil and electrode of a super-high pressure discharge lamp of the short arc type of the invention.
Figure 4B:
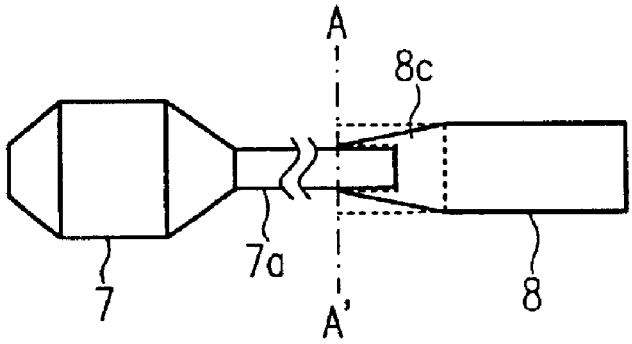
Figure 4C:
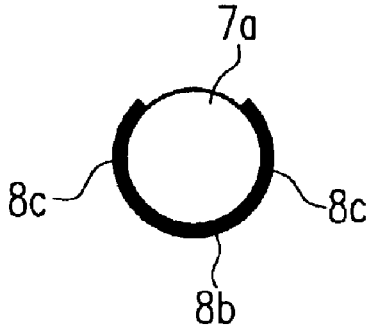
Figure 5:
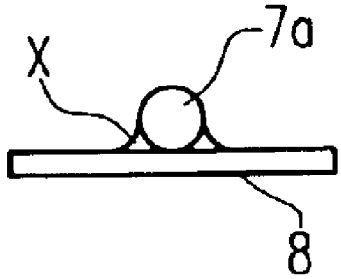
Fig. 5 (Prior Art)
FIG. 5 shows a schematic of the prior art.

Each of FIGS. 4(*a*) to 4(*c*) is an enlarged representation which is used to describe a second aspect of the a super-high pressure discharge lamp in accordance with the invention. FIG. 4(*a*) shows, like FIG. 2(*a*), the anode 7 and metal foil 8 before connection. FIG. 4(*b*) shows, like FIG. 2(*b*), the state after connecting the anode 7 to the metal foil 8. FIG. 4(*c*), like FIG. 2(*c*), is a cross section taken along line A–A' in FIG. 4(*b*). The difference from FIGS. 2(*a*) to 2(*c*) is that the tip area 8*a* with a small width as shown in FIGS. 2(*a*) to 2(*c*) is not present.

In FIG. 4(*a*), the metal foil 8 has a rectangular overall shape. However, here, an area 8*b* is connected to the electrodes and an area 8*c* is wrapped around the electrode axis after the weld connection is formed. In the figure, the areas are represented using broken line are merely to facilitate description and it is not necessary to actually divide the metal foil in this way. The area 8*b* of the metal foil is where connection to the electrode is formed in the welding process, such as by resistance welding or the like, being of a width that is the same as the diameter of the upholding part 7*a* of the electrode. The area 8*c* is wound around the electrode axis of the metal foil and is formed on the two sides of the connecting area 8*b*, the winding being performed manually, for example, after welding to the electrode.

Numerical values are described below by way of example. The diameter of the electrode axis is selected from the range of 0.3 mm to 1.5 mm and is, for example, 0.8 mm. The width of the area 8*b* of the metal foil is selected from the range of 0.3 mm to 1.0 mm and is, for example, 0.5 mm. The welding amount in the lengthwise direction is selected from the range of 1 mm to 3 mm and is, for example, 2 mm.

The connecting arrangement of the metal foil to the electrode in accordance with the invention is not limited to the anode, but can also be used for the cathode.

As the electrode arrangement, there is an arrangement comprised of a part with a larger diameter of the tip and of an electrode rod which supports it, like the arrangement of the anode shown in FIG. 1, and an arrangement in which the electrode as the electrode rod with the same diameter extends unchanged as far as the tip, as in the cathode as shown in FIG. 1. However, the connecting arrangement of the metal foil to the electrode as in accordance with the invention can be used for electrodes with any arrangement, without raising the question of whether they are to be used for an anode or a cathode.

Figure 6:
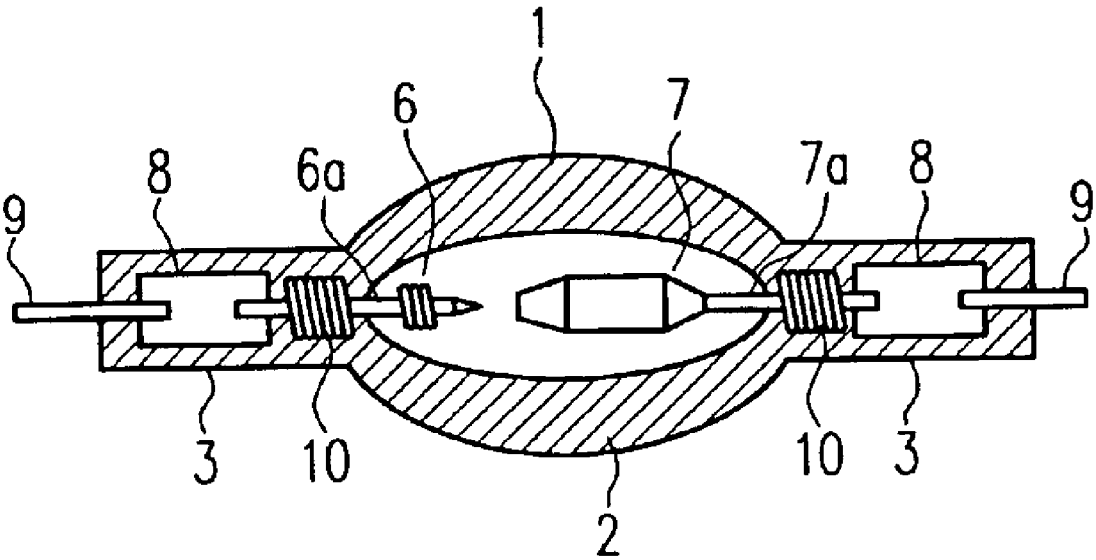
Fig. 6 (Prior Art)
FIG. 6 is a schematic depiction of a conventional super-high pressure discharge lamp of the short arc type.

The numerical values of the discharge lamp of the short arc type in accordance with the invention are described below by way of example:

outside diameter of the side tube portion: 6.0 mm
total length of the lamp: 65.0 mm
length of the side tube: 25.0 mm
inside volume of the arc tube: 0.08 $cm^3$
distance between the electrodes: 2.0 mm
rated luminous voltage: 200 W
rated luminous current: 2.5 A
amount of mercury added: 0.15 $mg/mm^3$
rare gas: 100 torr argon In the above described specification, in not even one of 120 discharge lamps in which the connecting arrangement of the electrode axis to the metal foil of the invention was used did a crack form to the extent that the lamp efficiency would be adversely affected, while in 51 of 120 discharge lamps with the conventional arrangement shown in FIG. 6 cracks did form which adversely affected efficiency.

As was described above, the super-high pressure mercury lamp of the short arc type as claimed in the invention has a super-high internal pressure during operation of greater than 150 atm. Operating conditions thereof are extremely strict. However, the crack prevention function can advantageously develop by the arrangement in which the width of the metal foil at the welding site on the electrode is fixed at a value no larger than the diameter of the electrode (in the range in which it is connected to the metal foil) or by the arrangement in which around the welding point around the electrode the unwelded area of the metal foil is wound around the electrode.

What we claim is:

1. Super-high pressure discharge lamp of the short arc type which comprises:

an arc tube portion in which there is a pair of opposed electrodes and which is filled with at least 0.15 $mg/mm^3$ mercury; and side tube portions which extend from opposite sides of the arc tube portion, in which the electrodes are partially hermetically enclosed and in which the electrodes are connected to outer leads via metal foils, the electrodes and metal foils being joined to one another by a welded connection, wherein the metal foils have a portion at one end that overlaps an end portion of the electrode and have a width in the area of the welded connection to the electrodes and to the full extent of said overlap that is less than the diameter of the electrodes in the area of the welded connection; and wherein the diameter of the electrode in the area of the welded connection and the extent of the overlap in the area of the welding site is 0.8 mm and the width of the metal foil is 0.5 mm.

2. Super-high pressure discharge lamp as of the short arc type which comprises:

an arc tube portion in which there is a pair of opposed electrodes and which is filled with at least 0.15 $mg/mm^3$ mercury; and side tube portions which extend from opposite sides of the arc tube portion, in which the electrodes are partially hermetically enclosed and in which the electrodes are connected to outer leads via metal foils, the electrodes and metal foils being joined to one another by a welded connection, wherein the metal foils have a portion at one end that overlaps an end portion of the electrode and have a width in the area of the welded connection to the electrodes and to the full extent of said overlap that is less than the diameter of the electrodes in the area of the welded connection; and wherein the width of the metal foil in the area of the welded connection is at least 70% of the diameter of the electrode in the area of the welded connection.

3. Super-high pressure discharge lamp of the short arc type, comprising:

an arc tube portion in which there is a pair of opposed electrodes and which is filled with at least 0.15 $mg/mm^3$ mercury; and side tube portions which extend from opposite sides of the arc tube portion, in which the electrodes are partially hermetically enclosed and in which the electrodes are connected to outer leads via metal foils, the electrodes and metal foils being joined to one another by a welded connection, wherein areas of the metal foils laterally adjacent to the welded connection are wound around a portion of the respective electrode, said areas having a width that is less than the diameter of the electrode.

4. Super-high pressure discharge lamp as claimed in claim 3, wherein the diameter of the electrode in the area of the welded connection is between 0.3 and 1.5 mm.

5. Super-high pressure discharge lamp as claimed in claim 4, wherein the diameter of the electrode in the area of the welded connection is 0.8 mm and the width of the metal foil is 0.5 mm.

6. Super-high pressure discharge lamp as claimed in claim 3, wherein the welded connection has a width between 0.3 and 1.0 mm and a length from 1 to 3 mm.

7. Super-high pressure discharge lamp as claimed in claim 6, wherein the welded connection has a width of 0.5 mm.

8. Super-high pressure discharge lamp as claimed in claim 6, wherein the welded connection has a length of 2 mm.

* * * * *